US009662552B2

(12) United States Patent
Sin

(10) Patent No.: US 9,662,552 B2
(45) Date of Patent: May 30, 2017

(54) GRIP AID FOR GOLF CLUB

(71) Applicant: Jai Choon Sin, Seoul (KR)

(72) Inventor: Jai Choon Sin, Seoul (KR)

(73) Assignee: Jai Choon Sin, Seoul (KR)

( * ) Notice: Subject to any disclaimer, the term of this patent is extended or adjusted under 35 U.S.C. 154(b) by 0 days.

(21) Appl. No.: 14/908,891

(22) PCT Filed: Jul. 31, 2014

(86) PCT No.: PCT/KR2014/007020
§ 371 (c)(1),
(2) Date: Jan. 29, 2016

(87) PCT Pub. No.: WO2015/016620
PCT Pub. Date: Feb. 5, 2015

(65) Prior Publication Data

US 2016/0175669 A1 Jun. 23, 2016

(30) Foreign Application Priority Data

Jul. 31, 2013 (KR) ..... 10-2013-0091002

(51) Int. Cl.
*A63B 53/14* (2015.01)
*A63B 60/12* (2015.01)
(Continued)

(52) U.S. Cl.
CPC ..... *A63B 53/14* (2013.01); *A63B 60/08* (2015.10); *A63B 60/10* (2015.10); *A63B 60/12* (2015.10); *A63B 60/14* (2015.10)

(58) Field of Classification Search
CPC ..... A63B 53/14; A63B 60/06; A63B 60/14; A63B 60/12; A63B 60/08; A63B 60/10; Y10T 29/53657
See application file for complete search history.

(56) References Cited

U.S. PATENT DOCUMENTS 1,669,053 A 5/1928 Hamel
2,038,840 A * 4/1936 Hall ..... A63B 53/14 29/235
(Continued)

FOREIGN PATENT DOCUMENTS

JP 6040905 B2 6/1994
JP 3103792 U 8/2004
(Continued)

OTHER PUBLICATIONS

International Search Report for Application No. PCT/KR2014/007020, issued Oct. 28, 2014.

*Primary Examiner* — Steven Wong
(74) *Attorney, Agent, or Firm* — Nutter McClennen & Fish LLP; John J. Penny, Jr.

(57) ABSTRACT

Disclosed is a grip aid for a golf club, which includes a grip aid body having an accommodation portion into which a golf club grip is inserted, and a projection for setting a gripping location of a golf club; and a first guide member detachably inserted into the accommodation portion and interposed between the accommodation portion and the golf club grip to guide movement of the golf club grip when the golf club grip is inserted into the accommodation portion, wherein after the golf club grip is inserted into the accommodation portion, the first guide member is drawn out of the accommodation portion so that the grip aid body is closely adhered to the golf club grip.
If this grip aid is used, the grip aid body may be easily mounted to the golf club grip by using the first guide member, and a gripping posture of the hand gripping the grip aid body may be consistently maintained while swinging the golf club, thereby improving accuracy of swinging and increasing a driving distance of a golf ball.

12 Claims, 19 Drawing Sheets

(51) Int. Cl.

| | |
|---|---|
| ***A63B 60/10*** | (2015.01) |
| ***A63B 60/08*** | (2015.01) |
| ***A63B 60/14*** | (2015.01) |

(56) References Cited

U.S. PATENT DOCUMENTS

| | | | | | |
|---|---|---|---|---|---|
| 4,068,364 | A * | 1/1978 | Tharp | A63B 53/14 | 29/235 |
| 4,313,250 | A * | 2/1982 | Sokolowski | B25B 27/02 | 29/235 |
| 4,466,166 | A * | 8/1984 | Hogarth | A63B 49/08 | 29/235 |
| 4,662,415 | A * | 5/1987 | Proutt | A63B 53/14 | 150/160 |
| 4,736,506 | A * | 4/1988 | Hanebrink | B23P 19/02 | 29/235 |
| 4,869,511 | A * | 9/1989 | Spoonster, Sr. | A63B 69/3638 | 473/203 |
| 4,878,667 | A * | 11/1989 | Tosti | A63B 53/14 | 43/22 |
| 5,685,052 | A * | 11/1997 | Meyers | B25B 27/0028 | 29/235 |
| 5,741,394 | A * | 4/1998 | Kennedy | A63B 53/14 | 156/293 |
| 6,036,607 | A * | 3/2000 | Finegan | A63B 53/14 | 473/206 |
| 6,049,960 | A * | 4/2000 | Pilling | B25B 27/28 | 29/235 |
| 2002/0132678 | A1* | 9/2002 | Matzie | A63B 53/14 | 473/203 |
| 2009/0313802 | A1* | 12/2009 | Schell | A63B 49/08 | 29/450 |
| 2015/0352417 | A1* | 12/2015 | Feehan | A63B 60/22 | 473/299 |

FOREIGN PATENT DOCUMENTS

| | | | |
|---|---|---|---|
| JP | 2009-112500 | A | 5/2009 |
| JP | 4263792 | B2 | 5/2009 |
| KR | 10-2008-0037330 | A | 4/2008 |

* cited by examiner

GRIP AID FOR GOLF CLUB

TECHNICAL FIELD

The present application claims priority to Korean Patent Application No. 10-2013-0091002 filed on Jul. 31, 2013 in the Republic of Korea, and PCT Application No. PCT/KR2014/007020 filed on Jul. 31, 2014, the disclosures of which are incorporated herein by reference.

The present disclosure relates to a grip aid for a golf club, which may be mounted to a grip of a golf club.

BACKGROUND ART

A general golf club includes a shaft, a head provided at one end of the shaft, a grip provided at the other end of the shaft, and so on. The grip is used for gripping the golf club and is generally made of soft rubber or other synthetic resin materials with a relatively high friction coefficient.

For accurate swing using a golf club, a gripping posture of the hand which is gripping the grip should be consistently maintained during swinging the golf club, more particularly between addressing for aligning the head of the golf club with a ball and impacting for hitting the ball.

However, since a great force is instantly applied to the grip while swinging the golf club, even though the grip is made of soft rubber or other synthetic resin materials with a relatively high friction coefficient, the hand gripping the grip may be shaken or slipped at the instant of impacting, and thus the gripping posture of the hand gripping the grip may not be consistently maintained during swinging.

DISCLOSURE

Technical Problem

The present disclosure is designed to solve the problems of the related art, and therefore the present disclosure is directed to providing a grip aid for a golf club, which may consistently maintain a gripping posture of the hand while swinging the golf club.

Further, the present disclosure is directed to providing a grip aid for a golf club, which is configured to be easily mounted to a golf club grip provided at the golf club.

Moreover, the present disclosure is directed to providing a grip aid for a golf club, which may be closely adhered to the golf club grip without being twisted or deviated from the golf club grip during swinging.

Technical Solution

In one aspect of the present disclosure, there is provided a grip aid for a golf club, comprising: a grip aid body having an accommodation portion into which a golf club grip is inserted, and a projection for setting a gripping location of a golf club; and a first guide member detachably inserted into the accommodation portion and interposed between the accommodation portion and the golf club grip to guide movement of the golf club grip when the golf club grip is inserted into the accommodation portion, wherein after the golf club grip is inserted into the accommodation portion, the first guide member is drawn out of the accommodation portion so that the grip aid body is closely adhered to the golf club grip.

Preferably, the grip aid body may have flexible elastic material.

Also preferably, the accommodation portion may have a smaller diameter than the golf club grip, and the golf club grip may be inserted into the accommodation portion while expanding the grip aid body, and when the first guide member is drawn from the accommodation portion, the grip aid body may be shrunken so that an inner side of the accommodation portion is closely adhered to an outer side of the golf club grip.

Preferably, the grip aid body may further include wrinkles formed along a longitudinal direction thereof and flexible in a circumferential direction of the grip aid body.

Preferably, the first guide member may include a first gripping portion exposed out of the accommodation portion to give a gripping surface; and a first guide unit detachably inserted into the accommodation portion to guide movement of the golf club grip.

More preferably, the first gripping portion may include a guide hole configured to guide the golf club grip to the accommodation portion when the golf club grip is inserted into the accommodation portion; and a fixing groove formed with a predetermined depth along a periphery of an outer side thereof so that one end of the accommodation portion is detachably coupled thereto to fix the grip aid body.

More preferably, the first gripping portion may be composed of a plurality of gripping units detachably coupled to each other, and the first guide unit be individually formed at each gripping unit.

In particular, the first guide unit may be inserted into the accommodation portion in a state where the plurality of gripping units are coupled to each other, and when the golf club grip is inserted into the accommodation portion, the plurality of gripping units may be separated from each other and draw the gripping units, respectively, so that the guide unit connected to each gripping unit is individually drawn from the accommodation portion.

More preferably, the first guide unit may have at least one guide projection protruding along a longitudinal direction thereof to contact at least one of an inner side of the accommodation portion and an outer side of the golf club grip.

Preferably, the grip aid may further include a second guide member into which at least a part of the golf club grip is detachably inserted, wherein when the golf club grip is inserted into the accommodation portion, the second guide member may be interposed between the first guide member and the golf club grip to guide movement of the golf club grip, wherein after the golf club grip is inserted into the accommodation portion, the second guide member may be drawn out of the accommodation portion so that the grip aid body is closely adhered to the golf club grip.

More preferably, the second guide member may include a second gripping portion exposed out of the accommodation portion to give a gripping surface; and a second guide unit detachably inserted into the golf club grip, the second guide unit being inserted into the accommodation portion in a state of surrounding the golf club grip to guide movement of the golf club grip.

In particular, the second guide member may further include a protrusion protruding from an outer side of the second guide unit to form a gap between the first guide member and the second guide unit.

In particular, the second guide unit may be composed of a plurality of guide units individually extending from the second gripping portion to surround at least a part of the golf club grip.

More preferably, at least one of the grip aid body, the first guide member and the second guide member may have a direction leader for indicating a reference direction to mount the grip aid body at a predetermined regular position of the golf club grip.

Advantageous Effects

First, since a golf club grip is inserted into an accommodation portion of the grip aid body in a state where a first guide member is already inserted into the accommodation portion of the grip aid body, the golf club grip may be easily inserted into the accommodation portion of the grip aid body.

Second, since the golf club grip is inserted into the accommodation portion of the grip aid body in a state where the golf club grip is covered with a second guide member so that the golf club grip does not directly contact the first guide member, the golf club grip may be more easily inserted into the accommodation portion of the grip aid body.

Third, if the golf club grip is inserted into the accommodation portion of the grip aid body, the first guide member and the second guide member may be respectively separated from the accommodation portion of the grip aid body so that the grip aid body is closely adhered to the golf club grip.

Fourth, since the first guide member and the second guide member may be divided into a plurality of pieces so that the pieces are individually separated from the accommodation portion of the grip aid body, the first guide member and the second guide member may be easily separated from the accommodation portion of the grip aid body.

Fifth, since a projection and a groove may be prepared at the outer circumference of the grip aid body to set a gripping location of the golf club so that an optimal gripping posture may be consistently maintained while swinging the golf club, it is possible to improve accuracy of swinging and increase a driving distance of a golf ball.

BEST MODE

Figure 1:
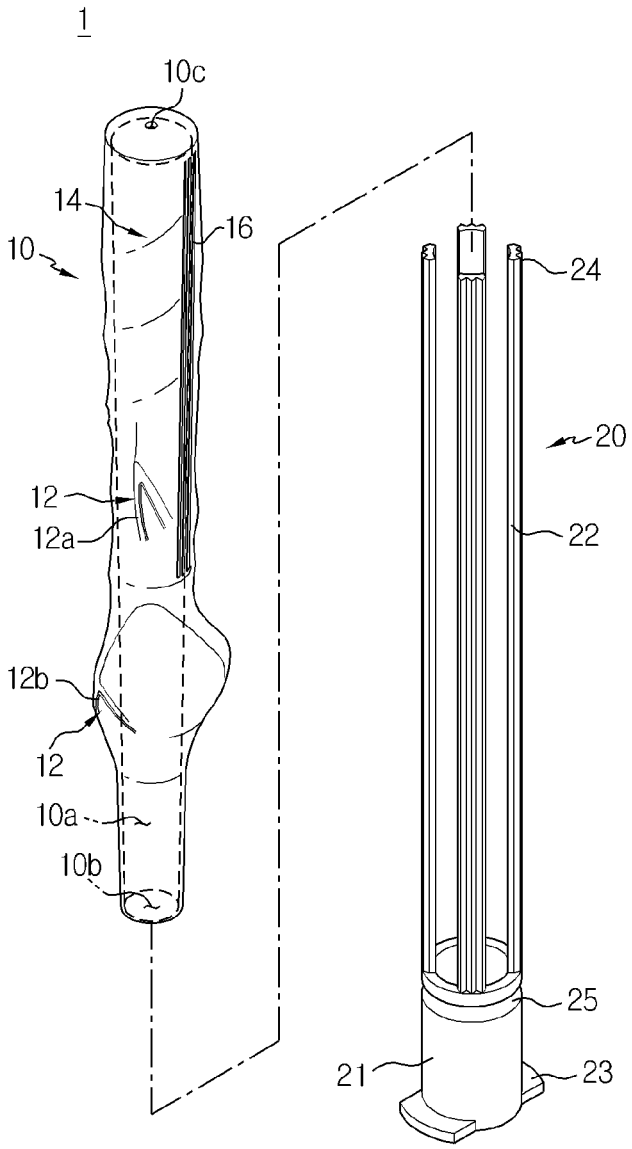
FIG. 1 is an exploded perspective view showing a grip aid for a golf club according to the first embodiment of the present disclosure.

It should be understood that the terms used in the specification and the appended claims should not be construed as limited to general and dictionary meanings, but interpreted based on the meanings and concepts corresponding to technical aspects of the present disclosure on the basis of the principle that the inventor is allowed to define terms appropriately for the best explanation. Therefore, the description proposed herein is just a preferable example for the purpose of illustrations only, not intended to limit the scope of the disclosure, so it should be understood that other equivalents and modifications could be made thereto without departing from the scope of the disclosure.

In the drawings, each component or a specific portion of each component is depicted in an exaggerated, excluded or simplified state for the convenience of understanding and clarity. Therefore, the size of each component may not fully reflect an actual size. Also, any explanation of the prior art known to relate to the present invention may be omitted if it is regarded to render the subject matter of the present invention vague.

FIG. 1 is an exploded perspective view showing a grip aid for a golf club according to the first embodiment of the present disclosure.

Referring to FIG. 1, a grip aid 1 for a golf club according to the first embodiment of the present disclosure includes a grip aid body 10 having an accommodation portion 10*a* into which a golf club grip G is inserted, and a first guide member 20 detachably inserted into the accommodation portion 10*a* and interposed between the accommodation portion 10*a* and the golf club grip G to guide movement of the golf club grip G when the golf club grip G is inserted into the accommodation portion 10*a*. In addition, if the golf club grip G is inserted into the accommodation portion 10*a* of the grip aid body 10, the first guide member 20 is drawn out of the accommodation portion 10*a* so that the grip aid body 10 is closely adhered to the golf club grip G. In this specification, the golf club grip G represents a handle of the golf club C, which is coupled to an end of a shaft S of the golf club C and allows the golf club C to be gripped.

The grip aid body 10 is coupled to the golf club C to surround the golf club grip G in order to set a gripping location of the golf club grip G. For this, as shown in FIG. 1, the grip aid body 10 includes an accommodation portion 10*a* into which the golf club grip G is inserted, an inlet 10*b* having a passage through which a first gripping portion 21 of the first guide member 20 is inserted, an air discharge hole 10*c* giving a passage for discharging air when the golf club grip G is inserted into the accommodation portion 10*a*, a projection 12 and a groove 14 for setting a gripping location of the golf club C, and wrinkles 16 for giving flexibility to the grip aid body 10. The grip aid body 10 may be formed with flexible elastic material, for example soft rubber or other synthetic resin materials with a relatively high friction coefficient, so as to be closely adhered to the golf club grip G.

The accommodation portion 10*a* is a space for accommodation, provided in the grip aid body 10 for the insertion of the golf club grip G, and is communicate with an inlet 10*b* and an air discharge hole 10*c* of the grip aid body 10. The accommodation portion 10*a* may have various shapes depending on the shape of the golf club grip G to which the grip aid 1 for a golf club according to the first embodiment of the present disclosure is to be applied. For example, if the golf club grip G has a cylindrical shape, the accommodation portion 10*a* may also have a cylindrical shape corresponding to the shape of the golf club grip G. The accommodation portion 10*a* has a slightly smaller diameter than the golf club grip G so that the grip aid body 10 may be closely adhered to the golf club grip G by means of the elasticity of the grip aid body 10.

The inlet 10*b* is formed at one end of the grip aid body 10 to communicate with the accommodation portion 10*a*, and gives a passage through which a gripping portion 21, explained later, of the first guide member 20 may be inserted into the accommodation portion 10*a*.

The air discharge hole 10*c* is formed at the other end of the grip aid body 10 to communicate with the accommodation portion 10*a*, and gives a passage for discharging air filled in the accommodation portion 10*a* to the outside when the golf club grip G is inserted into the accommodation portion 10*a*. If an air layer is formed between the accommodation portion 10*a* and the golf club grip G, the inner side of the accommodation portion 10*a* is not closely adhered to the outer side of the golf club grip G due to the air layer. Therefore, the air discharge hole 10*c* is formed to prevent an air layer from being formed between the accommodation portion 10*a* and the golf club grip G.

The projection 12 and the groove 14 are formed at the outer side of the grip aid body 10 to set a gripping location of the golf club C. In other words, the projection 12 and the groove 14 may be respectively formed at predetermined locations to individually set gripping locations of the right hand and the left hand, and its location may be changed depending on whether the golf club is a right-hander golf club or a left-hander golf club. Hereinafter, for convenience, it will be explained that the grip aid 1 for a golf club according to the first embodiment of the present disclosure is applied to a right-hander golf club.

As shown in FIG. 1, the projection 12 may have a first projection 12*a* and a second projection 12*b*, protruding with a 'V' shape at upper and lower portions of the outer side of the grip aid body 10, respectively. A user may grip the first projection 12*a* and the second projection 12*b* using the thumbs and the forefingers of the left hand and the right hand, respectively, so that the lower ends of the first projection 12*a* and the second projection 12*b* are respectively interposed between the thumbs and the forefingers of the left hand and the right hand.

The locations of the first projection 12*a* and the second projection 12*b* are not specially limited, but the first projection 12*a* and the second projection 12*b* may be formed at gripping locations where a user may maintain an optimal gripping posture, thereby individually setting gripping locations of the thumbs and the forefingers of the right hand and the left hand. The optimal gripping posture represents, for example, a gripping posture with which a head (not shown) of the golf club C and a ball may form an acute angle of about 5° at swinging.

A plurality of grooves 14 may be formed in at least one portion between the first projection 12*a* and the second projection 12*b*, between the second projection 12*b* and the lower end of the grip aid body 10, and between the first projection 12*a* and the upper end of the grip aid body 10 to individually set gripping locations of the middle fingers, the ring fingers and the little fingers of the right hand and the left hand.

The projection 12 and the groove 14 may be, for example, formed by means of injection molding integrally with the grip aid body 10, without being limited thereto. The projection 12 and the groove 14 may also be prepared separately and attached to the outer side of the grip aid body 10.

When the projection 12 and the groove 14 are gripped, first, the first projection 12*a* may be gripped using the thumb and the forefinger of the left hand, and then the grooves 14 provided in at least one portion below the first projection 12*a* and between the first projection 12*a* and the upper end of the grip aid body 10 may be gripped using the middle finger, the ring finger and the little finger of the left hand. After that, the second projection 12*b* may be gripped using the thumb and the forefinger of the right hand, and then the grooves 14 provided between the second projection 12*b* and the first projection 12*a* may be gripped using the middle finger and the ring finger of the right hand. The little finger of the right hand may press the forefinger of the left hand which is gripping the first projection 12*a*, without being limited thereto.

Since the projection 12 and the groove 14 are provided as described above, a user may firmly grip the grip aid body 10 by using the projection 12 and the groove 14 so that the hand is not slipped from the grip aid body 10. Therefore, when swinging the golf club C, the user may maintain an optimal gripping posture, thereby improving accuracy in swinging and increasing a driving distance of the ball.

The wrinkles 16 are formed along the longitudinal direction of the grip aid body 10 and are flexible in the circumferential direction of the grip aid body 10. The wrinkles 16 may be prepared by forming a plurality of grooves in the outer circumference of the grip aid body 10 along the longitudinal direction of the grip aid body 10. In addition, as shown in FIG. 1, the wrinkles 16 may be formed in a region where the projection 12 is not formed, without being limited thereto.

The wrinkles 16 are flexible in the circumferential direction of the grip aid body 10 and thus function to reinforce elasticity of the grip aid body 10. Therefore, when the golf club grip G is inserted into the accommodation portion 10*a*, the wrinkles 16 extend in the circumferential direction of the grip aid body 10 so that the golf club grip G may be easily inserted into the accommodation portion 10*a*.

Figure 2:
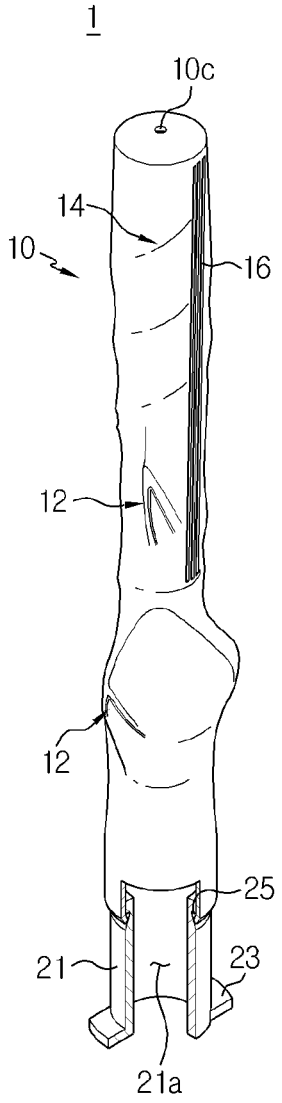
FIG. 2 is a partially sectioned perspective view showing a grip aid for a golf club according to the first embodiment of the present disclosure, in which a grip aid body is coupled to a first guide member.

FIG. 2 is a partially sectioned perspective view showing a grip aid for a golf club according to the first embodiment of the present disclosure, in which a grip aid body is coupled to a first guide member.

Generally, the golf club grip G is made of soft rubber or other synthetic resin materials with a relatively high friction coefficient so that the hand of a user is not slipped from the golf club grip G. In addition, the grip aid body 10 is also made of soft rubber or other synthetic resin materials with a relatively high friction coefficient. Therefore, if the golf club grip G is directly inserted into the accommodation portion 10*a*, a strong friction is applied between the accommodation portion 10*a* and the golf club grip G, and thus the golf club grip G may not be easily inserted into the accommodation portion 10*a*. For this reason, the grip aid 1 for a golf club according to the first embodiment of the present disclosure employs the first guide member 20 for guiding movement of the golf club grip G when the golf club grip G is inserted into the accommodation portion 10*a*.

The first guide member 20 is interposed between the accommodation portion 10*a* and the golf club grip G to reduce a friction applied to the golf club grip G, thereby guiding the movement of the golf club grip G. After the golf club grip G is inserted into the accommodation portion 10*a*, the first guide member 20 is separated from the accommodation portion 10*a*. For this, as shown in FIGS. 1 and 2, the first guide member 20 includes a first gripping portion 21 exposed out of the accommodation portion 10*a* to give a gripping surface, and a first guide unit 22 extending from the first gripping portion 21 and inserted into the accommodation portion 10*a* to guide movement of the golf club grip G. The first guide member 20 may be made of, for example, polypropylene (PP) or other soft synthetic resin materials having a relatively low friction coefficient to give a slippery property, without being limited thereto.

When the golf club grip G is inserted into the accommodation portion 10*a*, the first gripping portion 21 guides the golf club grip G to the accommodation portion 10*a*, and when the first guide member 20 is separated from the grip aid body 10, the first gripping portion 21 gives a grip tip for gripping the first guide member 20. For this, as shown in FIGS. 1 and 2, the first gripping portion 21 includes a guide hole 21*a* for guiding the golf club grip G to the accommodation portion 10*a*, a handle 23 giving a gripping surface, and a fixing groove 25 for fixing the accommodation portion 10*a*.

The guide hole 21*a* is formed in the first gripping portion 21 to communicate with the accommodation portion 10*a* in order to guide the golf club grip G to the accommodation portion 10*a* when the golf club grip G is inserted into the accommodation portion 10*a*. The guide hole 21*a* has a greater diameter than the golf club grip G so that the golf club grip G may pass therethrough.

The front end of the first gripping portion 21 gives a gripping surface which is exposed out of the accommodation portion 10*a* so that the first guide member 20 may be gripped, when the first guide unit 22 is inserted into the accommodation portion 10*a*. At least one handle 23 may be provided at the front end of the first gripping portion 21 so that the first guide member 20 may be gripped more easily.

The rear end of the first gripping portion 21 has a greater diameter than the accommodation portion 10*a*, and by doing so, when the first guide unit 22 is inserted into the accommodation portion 10*a*, a part of the rear end of the first gripping portion 21 is inserted into the accommodation portion 10*a* while spreading the front end of the accommodation portion 10*a* through the inlet 10*b* of the grip aid body 10. The front end of the accommodation portion 10*a* spread by the first gripping portion 21 is closely adhered to the rear end of the first gripping portion 21 by means of the elastic force of the grip aid body 10. Therefore, since the front end of the accommodation portion 10*a* of the grip aid body 10 is spread greater than the diameter of the golf club grip G, the golf club grip G may be inserted into the accommodation portion 10*a* more easily.

In addition, the fixing groove 25 having a predetermined depth is formed at the rear end of the first gripping portion 21 along the periphery of the first gripping portion 21. By doing so, as shown in FIG. 2, if the front end of the accommodation portion 10*a* moves to the fixing groove 25, the front end of the accommodation portion 10*a* is shrunken by the elastic force of the grip aid body 10 and inserted into the fixing groove 25. Therefore, when the golf club grip G is inserted into the accommodation portion 10*a*, the grip aid body 10 may be fixed to the gripping portion 21 so that the grip aid body 10 is not shaken.

The first guide unit 22 extends from the rear end of the first gripping portion 21 and includes a guide projection 24 protruding along a longitudinal direction thereof to contact at least one of the inner side of the accommodation portion 10*a* and the outer side of the golf club grip G.

The number of the first guide unit 22 is not specially limited. For example, as shown in FIG. 1, four first guide units 22 may be formed to extend from the first gripping portion 21. Each first guide unit 22 has a curved shape to surround at least a part of the golf club grip G. In addition, each first guide unit 22 may have a length so that its end moves adjacent to the other end of the grip aid body 10 where the air discharge hole 10*c* is provided, when being inserted into the accommodation portion 10*a*, without being limited thereto. The first guide unit 22 may be formed in various ways. For example, the first guide unit 22 may be injection-molded integrally with the first gripping portion 21. The first guide unit 22 may also be fabricated separately and then attached to the first gripping portion 21.

As shown in FIG. 1, the guide projection 24 protrudes from the outer side of the first guide unit 22 so as to make a linear contact to the inner side of the accommodation portion 10*a*. Since the guide projection 24 is provided, when the first guide unit 22 is inserted into the accommodation portion 10*a*, a contact area between the first guide unit 22 and the inner side of the accommodation portion 10*a* is reduced. Therefore, a friction occurring between the first guide unit 22 and the inner side of the accommodation portion 10*a* decreases so that the first guide unit 22 may be easily drawn from the accommodation portion 10*a*. In addition, the guide projection 24 may give a passage for discharging air between the inner side of the accommodation portion 10*a* and the first guide unit 22 or between the outer side of the golf club grip G and the first guide unit 22. In other words, the guide projection 24 gives a passage through which air not discharged out but staying therein may move toward the air discharge hole 10*c*, thereby preventing air bubbles from remaining between the accommodation portion 10*a* and the golf club grip G.

Meanwhile, even though it has been illustrated that the guide projection 24 is formed at the outer side of the first guide unit 22, the present disclosure is not limited thereto. In other words, the guide projection 24 may protrude from the inner side of the first guide unit 22 to make a contact with the outer side of the golf club grip G or may be formed at both the outer and inner sides of the first guide unit 22.

FIGS. 3 to 6 are perspective views and cross-sectional views for illustrating a process of mounting the grip aid body of the grip aid for a golf club according to the first embodiment of the present disclosure to a golf club grip.

Figure 3:
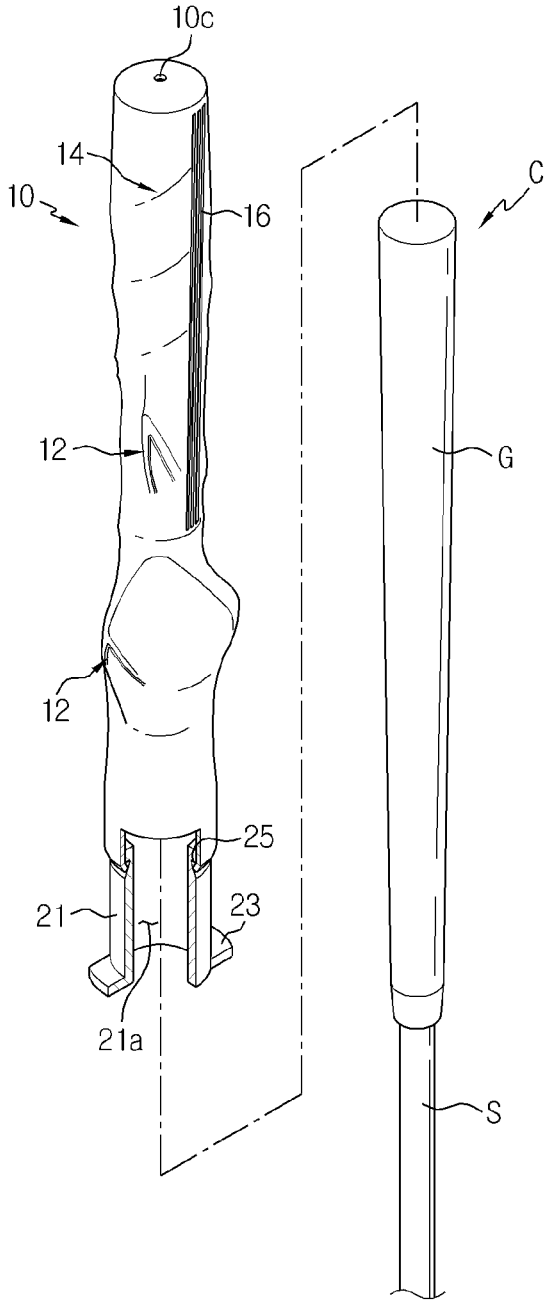
FIGS. 3 to 6 are perspective views and cross-sectional views for illustrating a process of mounting the grip aid body of the grip aid for a golf club according to the first embodiment of the present disclosure to a golf club grip.

First, as shown in FIG. 3, the first guide unit 22 is inserted into the accommodation portion 10*a* through the inlet 10*b* of the grip aid body 10, and the front end of the accommodation portion 10*a* is fixed to the fixing groove 25 of the first gripping portion 21 to couple the first guide member 20 to the grip aid body 10.

Figure 4:
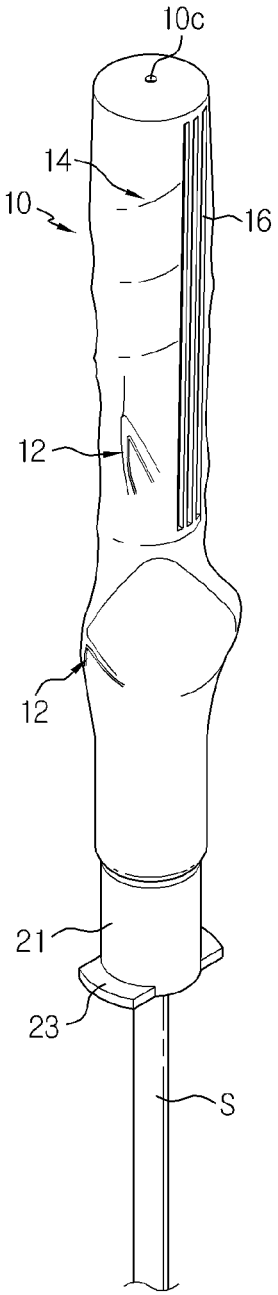

Next, as shown in FIG. 4, the golf club grip G is inserted into the accommodation portion 10*a* through the guide hole 21*a* of the first gripping portion 21.

Figure 5:
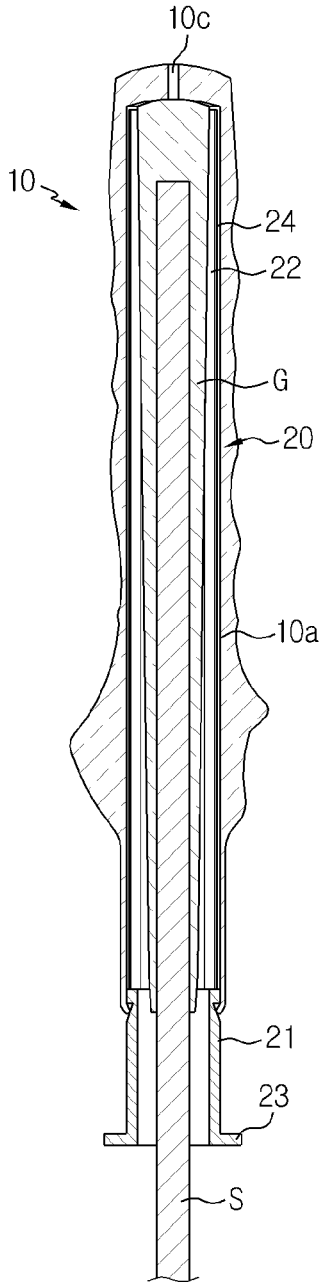

If the golf club grip G is inserted into the accommodation portion 10*a*, the first guide unit 22 is pushed toward the inner side of the accommodation portion 10*a* due to the golf club grip G, and the first guide unit 22 is interposed between the inner side of the accommodation portion 10*a* and the outer side of the golf club grip G. By doing so, as shown in FIG. 5, the inner side of the accommodation portion 10*a* is spaced as much as an interval between the outer side of the golf club grip G and the first guide unit 22 in a thickness direction. Therefore, the golf club grip G does not come into contact with the accommodation portion 10*a* but may move into the accommodation portion 10*a* in contact with the first guide unit 22.

Since the first guide member 20 is made of soft synthetic resin having a slippery property due to a relatively low friction coefficient, a friction occurring between the first guide unit 22 and the golf club grip G is smaller than the friction occurring between the grip aid body 10 and the golf club grip G which are made of rubber or other synthetic resin materials with a relatively high friction coefficient. Therefore, the golf club grip G may be easily pushed in to the other end of the grip aid body 10 where the air discharge hole 10*c* is provided, so as to be inserted into the accommodation portion 10*a*.

Figure 6:
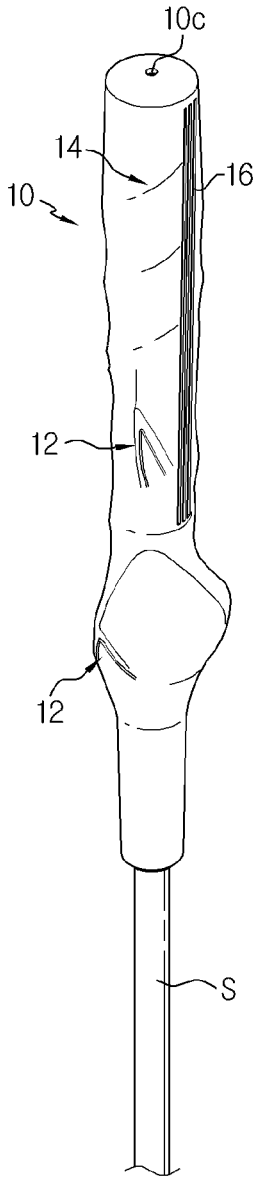

After, as shown in FIG. 6, the first guide member 20 is separated from the grip aid body 10, and the grip aid body 10 and the golf club grip G are closely adhered to each other.

The handle 23 of the first gripping portion 21 is pulled in an outer direction of the accommodation portion 10*a*, in more detail toward the head of the golf club C to draw the first guide unit 22 of the first gripping portion 21 out of the accommodation portion 10*a*, thereby separating the first guide member 20 from the grip aid body 10.

If the first guide member 20 is separated from the grip aid body 10, as shown in FIG. 6, the grip aid body 10 is shrunken due to elasticity. By doing so, the inner side of the accommodation portion 10*a* is closely adhered to the outer side of the golf club grip G, and thus the grip aid body 10 and the golf club grip G are coupled to each other.

Since both the grip aid body 10 and the golf club grip G are made of rubber or other synthetic resin materials with a relatively high friction coefficient, if the inner side of the accommodation portion 10*a* is closely adhered to the outer side of the golf club grip G, a strong friction occurs between the inner side of the accommodation portion 10*a* and the outer side of the golf club grip G. Therefore, even though a user makes a strong swing in state of gripping the grip aid body 10, it is possible to prevent the grip aid body 10 from being twisted or separated from the golf club grip G. For this reason, a user may swing the golf club C with a firm grip by using the projection 12 and the groove 14 for setting a gripping location, thereby improving accuracy of swinging and increasing a driving distance of a ball.

Figure 7:
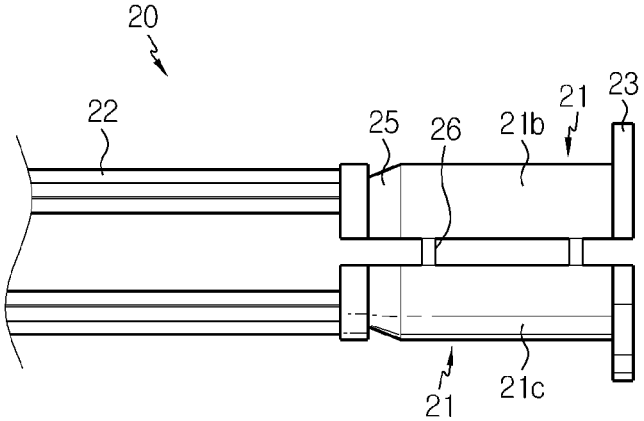
FIG. 7 is a partially enlarged view showing a first guide member having another shape, in the grip aid for a golf club according to the first embodiment of the present disclosure.

FIG. 7 is a partially enlarged view showing a first guide member having another shape, in the grip aid for a golf club according to the first embodiment of the present disclosure.

After the golf club grip G is inserted into the accommodation portion 10*a*, the first guide member 20 separated from the grip aid body 10 is restrained by the golf club C since the shaft S of the golf club C is inserted into the guide hole 21*a* of the first gripping portion 21, and thus a process for separating the first guide member 20 from the golf club C is additionally required. However, since the head is provided at the front end of the golf club C and the grip aid body 10 is mounted to the golf club grip G provided at the rear end of the golf club C, the first gripping portion 21 may be caught by the head of the golf club C or the projection 14 of the grip aid body 10, which may make it difficult to separate the first guide member 20 from the golf club C. Therefore, the first guide member 20 may be separated from the golf club C by cutting the first gripping portion 21 of the first guide member 20, separated from the grip aid body 10, by using a nipper or cutter.

If a cutting area of the first gripping portion 21 for separating the first guide member 20 from the golf club C is great, a great force is required for cutting the first gripping portion 21, and the user may be easily damaged due to the nipper or cutter. To solve this problem, the first gripping portion 21 may include a plurality of gripping units and a connector 26 for connecting the gripping units to each other. For example, as shown in FIG. 7, the first gripping portion 21 may include a first gripping unit 21*b* and a second gripping unit 21*c* having the same structure, and at least one pair of connectors 26 for connecting both ends of the first gripping unit 21*b* and the second gripping unit 21*c* to each other. In addition, at least one first guide unit 22 may be individually formed at each gripping unit 21*b*, 21*c* to extend therefrom.

The connector 26 is provided between the first gripping unit 21*b* and the second gripping unit 21*c* and couples the first gripping unit 21*b* and the second gripping unit 21*c* integrally. The connector 26 is provided to have a band shape with a smaller width than the first gripping unit 21*b* and the second gripping unit 21*c*. In addition, the connector 26 may be injection-molded integrally with the first gripping unit 21*b* and the second gripping unit 21*c*, without being limited thereto.

Since the first gripping portion 21 is provided as above, when the first guide member 20 is coupled to the grip aid body 10, in a state where the first gripping unit 21*b* and the second gripping unit 21*c* are integrally coupled by means of the connector 26, the first guide member 20 may be coupled to the grip aid body 10. In addition, when separating the first guide member 20 from the grip aid body 10 after the golf club grip G is inserted into the accommodation portion 10*a*, first, the connector 26 is cut with a nail clippers or cutter to release the coupling between the first gripping unit 21*b* and the second gripping unit 21*c*. After that, the first guide unit 22 connected to each gripping unit 21*b*, 21*c* may be individually drawn from the accommodation portion 10*a* to separate the first guide member 20 from the grip aid body 10.

Since the connector 26 has a band shape with a smaller width than the first gripping unit 21*b* and the second gripping unit 21*c*, the connector 26 may be easily cut with just a small force, and the user may not be easily damaged by a nail clippers or cutter while being cut. In addition, the first gripping portion 21 is divided into the first gripping unit 21*b* and the second gripping unit 21*c* by cutting the connector 26, only the first guide unit 22 connected to each gripping unit 21*b*, 21*c* may be selectively drawn from the accommodation portion 10*a*, without drawing the plurality of first guide units 22 inserted into the accommodation portion 10*a* at once from the accommodation portion 10*a*. Therefore, the force used for drawing the first guide unit 22 from the accommodation portion 10*a* may be distributed, and thus the first guide unit 22 may be easily drawn from the accommodation portion 10*a*.

Figure 8:
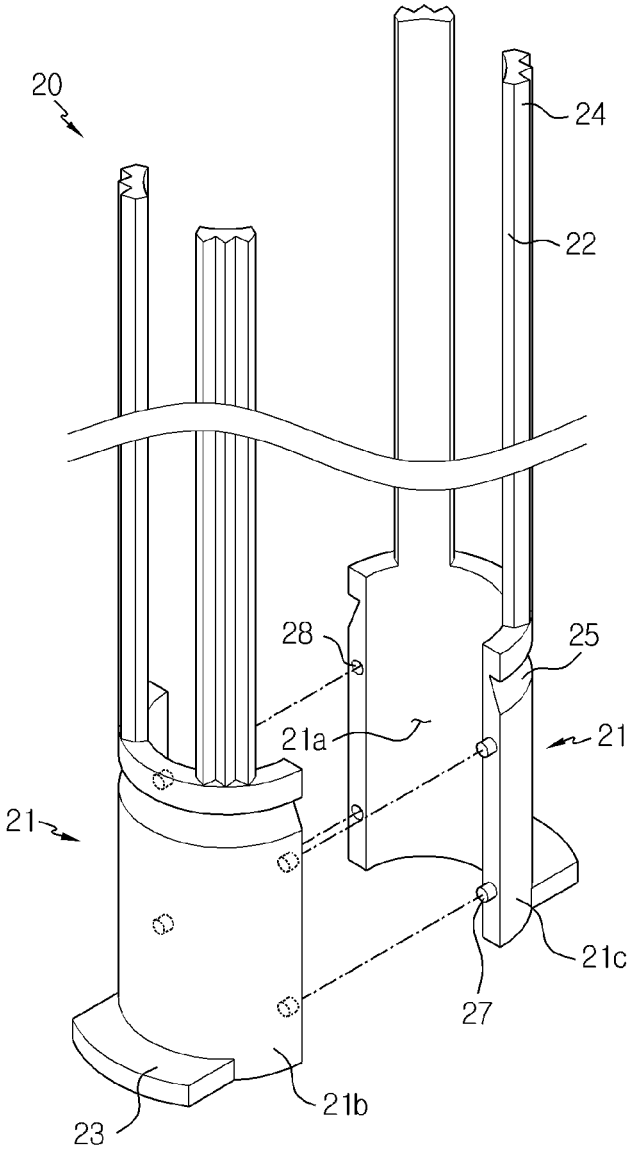
FIG. 8 is an exploded perspective view showing a first guide member having still another shape, in the grip aid for a golf club according to the first embodiment of the present disclosure.

FIG. 8 is an exploded perspective view showing a first guide member having still another shape, in the grip aid for a golf club according to the first embodiment of the present disclosure.

As described above, if the first gripping portion 21 is composed of the first gripping unit 21*b*, the second gripping unit 21*c* and the connector 26, the first guide member 20 separated from the grip aid body 10 by cutting the connector 26 may be released from the golf club C. However, since the connector 26 is cut, the first guide member 20 may not be reused, which increases costs required for preparing the first guide member 20.

To solve this problem, the first gripping portion 21 of the first guide member 20 may be composed of a plurality of gripping units, which may be coupled to or separated from, each other, and at least one first guide unit 22 may be formed at each gripping unit to extend therefrom. For example, as shown in FIG. 8, the first gripping portion 21 may be composed of a first gripping unit 21*b* and a second gripping unit 21*c* having the same structure and coupled to or separable from each other, and at least one first guide unit 22 may be formed at each gripping unit 21*b*, 21*c* to extend therefrom.

The first gripping unit 21*b* and the second gripping unit 21*c* may be coupled or separated in various ways. For example, as shown in FIG. 8, the first gripping unit 21*b* and the second gripping unit 21*c* respectively include a coupling projection 27 formed at one of both coupling surfaces and a coupling groove 28 formed at the other of the coupling surfaces. The coupling projection 27 has a shape corresponding to the coupling groove 28 so as to be detachably inserted into the coupling groove 28. Therefore, the first gripping unit 21*b* and the second gripping unit 21*c* may be integrally coupled by inserting the coupling projection 27 provided at any one of the first gripping unit 21*b* and the second gripping unit 21*c* into the coupling groove 28 provided at the other thereof.

Since the first gripping portion 21 is provided as above, when the first guide member 20 is coupled to the grip aid body 10, the first guide member 20 may be coupled to the grip aid body 10 in a state where the first gripping unit 21*b* and the second gripping unit 21*c* are integrally coupled. In addition, when separating the first guide member 20 from the grip aid body 10 after the golf club grip G is inserted into the accommodation portion 10*a*, first, the coupling groove 28 and the coupling projection 27 are separated to release the coupling between the first gripping unit 21*b* and the second gripping unit 21*c*. After that, the first guide unit 22 connected to each gripping unit 21*b*, 21*c* may be individually drawn from the accommodation portion 10*a* to separate the first guide member 20 from the grip aid body 10.

If the coupling projection 27 is separated from the coupling groove 28 to release the coupling between the first gripping unit 21*b* and the second gripping unit 21*c*, the first guide member 20 may be separated from the golf club C without cutting the first gripping portion 21 or the connector 26. Therefore, the first guide member 20 may be reused, which reduces costs required for preparing the first guide member 20. In addition, since only the first guide unit 22 connected to each gripping unit 21*b*, 21*c* may be selectively drawn from the accommodation portion 10*a*, the first guide unit 22 may be easily drawn from the accommodation portion 10*a*.

Meanwhile, the method of coupling or separating the plurality of gripping units by using the connector 26 and the method of coupling or separating the plurality of gripping units by using the coupling groove 28 and the coupling projection 27, as described above, may not be alternatively selected. For example, some of the plurality of gripping units may be coupled or separated using the connector 26, and the other gripping units may be coupled or separated using the coupling groove 28 and the coupling projection 27.

Figure 9:
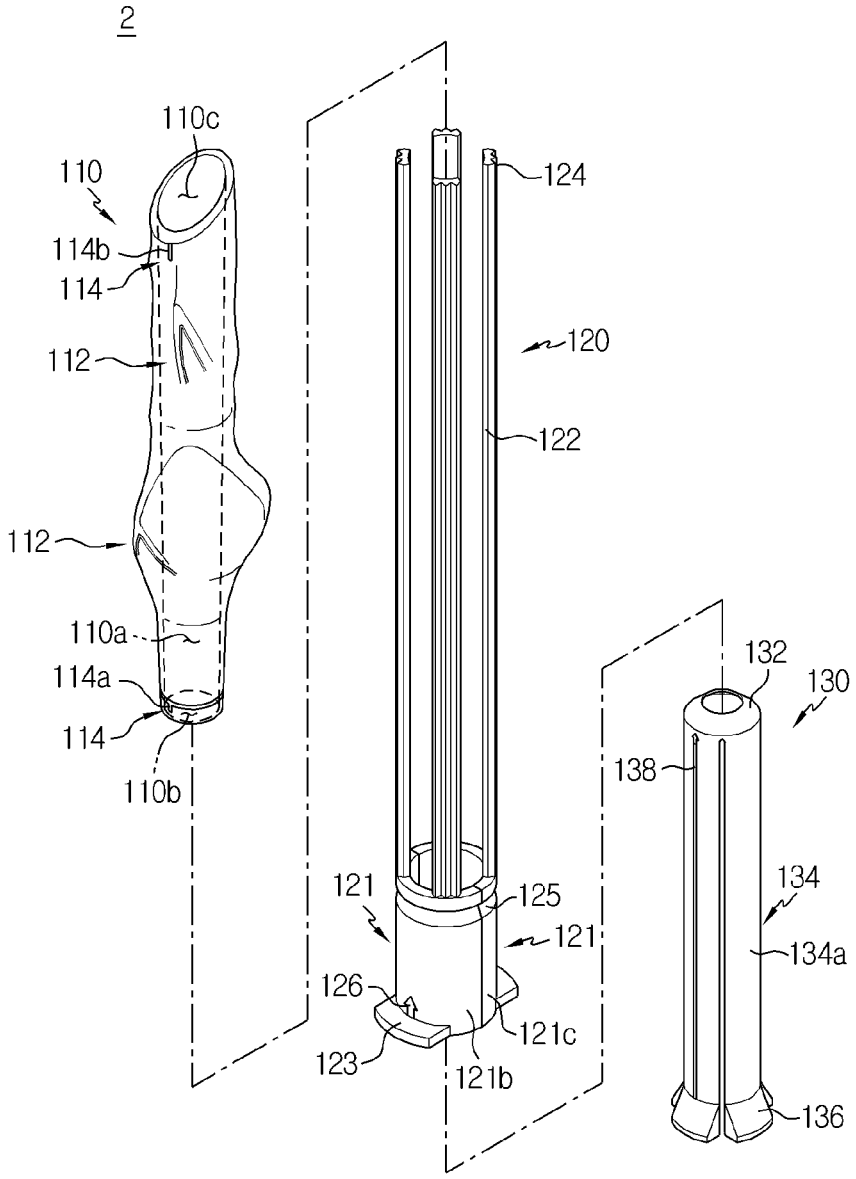
FIG. 9 is an exploded perspective view showing a grip aid for a golf club according to the second embodiment of the present disclosure.
Figure 10:
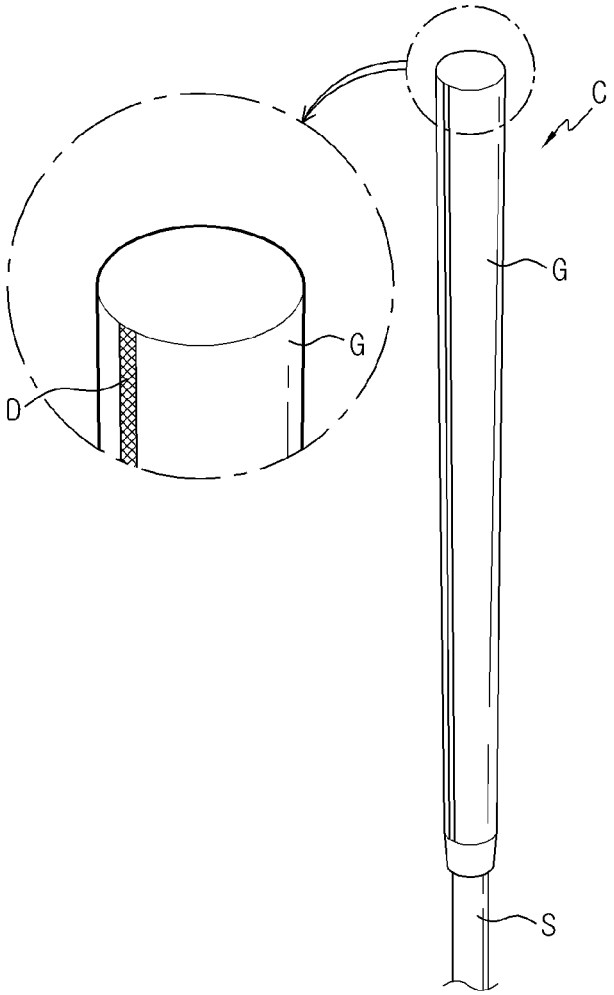
FIG. 10 is a perspective view showing a golf club grip provided at a general golf club.

FIG. 9 is an exploded perspective view showing a grip aid for a golf club according to the second embodiment of the present disclosure, and FIG. 10 is a perspective view showing a golf club grip provided at a general golf club.

Referring to FIG. 9, a grip aid 2 for a golf club according to the second embodiment of the present disclosure includes a grip aid body 110 having an accommodation portion 110*a* into which a golf club grip G is inserted, a first guide member 120 detachably inserted into the accommodation portion 110*a* and interposed between the accommodation portion 110*a* and the golf club grip G to guide movement of the golf club grip G when the golf club grip G is inserted into the accommodation portion 110*a*, and a second guide member 130 into which at least a part of the golf club grip G is detachably inserted, the second guide member 130 being interposed between the first guide member 120 and the golf club grip G to guide movement of the golf club grip G when the golf club grip G is inserted into the accommodation portion 110*a*. In addition, if the golf club grip G is inserted into the accommodation portion 110*a* of the grip aid body 110, the first guide member 120 and the second guide member 130 are drawn out of the accommodation portion 110*a* so that the grip aid body 110 is closely adhered to the golf club grip G.

The grip aid 2 for a golf club according to the second embodiment of the present disclosure further includes the second guide member 130 which is interposed between the first guide member 120 and the golf club grip G when the golf club grip G is inserted into the accommodation portion 110*a* and is also associated with the first guide member 120 to guide movement of the golf club grip G, different from the grip aid 1 for a golf club according to the first embodiment of the present disclosure. Hereinafter, the grip aid 2 for a golf club according to the second embodiment of the present disclosure will be described based on the above difference, and any feature identical to that of the grip aid 1 for a golf club according to the first embodiment of the present disclosure will not be described in detail here.

The grip aid body 110 is coupled to the golf club grip G to surround the golf club grip G in order to set a gripping location of the golf club C. For this, as shown in FIG. 9, the grip aid body 110 includes an accommodation portion 110*a* into which the golf club grip G is inserted, an inlet 110*b* giving a passage into which a first gripping portion 121 of the first guide member 120 is inserted, an air discharge hole 110*c* giving a passage for discharging air when the golf club grip G is inserted into the accommodation portion 110*a*, a projection 112 for setting a gripping location of the golf club C, and a direction leader 114 for indicating a reference direction to mount the grip aid body 110 to a predetermined regular position of the golf club grip G. The grip aid body 110 is substantially identical to the grip aid body 10 of the grip aid 1 for a golf club according to the first embodiment of the present disclosure, except that the air discharge hole 110*c* has a greater diameter so that a second guide member 130, described later, may be separated from the accommodation portion 110*a* through the air discharge hole 110*c*, the groove 14 and the wrinkles 16 are not included, and the direction leader 114 is further included.

The direction leader 114 is formed at the outer side of the grip aid body 110 and indicates a reference direction so that the grip aid body 110 may be mounted at a predetermined regular position of the golf club grip G. As shown in FIG. 10, a direction leader D indicating center point of the head is generally formed at the golf club grip G so that the golf club C may be gripped with a consistent posture. The direction leader 114 is formed to form a straight line with the direction leader D of the golf club grip G. Therefore, the grip aid body 110 may be mounted at a predetermined regular position of the golf club grip G by mounting the grip aid body 110 to the golf club grip G so that the direction leader 114 forms a straight line with the direction leader D of the golf club grip G.

The number and location of the direction leader 114 are not specially limited. For example, as shown in FIG. 9, the grip aid body 110 may include two direction leaders 114, namely a first direction leader 114*a* formed adjacent to the inlet 110*b* and a second direction leader 114*b* formed adjacent to the air discharge hole 110*c*. A method for mounting the grip aid body 110 to a predetermined regular position of the golf club grip G by using the first direction leader 114*a* and the second direction leader 114*b* will be described later in detail.

The air discharge hole 110*c* is formed at the other end of the grip aid body 110 to communicate with the accommodation portion 110*a*, and gives a passage for discharging air, filled in the accommodation portion 110*a*, when the golf club grip G is inserted into the accommodation portion 110*a*. If an air layer is formed between the accommodation portion 110*a* and the golf club grip G, the inner side of the accommodation portion 110*a* is not closely adhered to the outer side of the golf club grip G due to the air layer. Therefore, the air discharge hole 110*c* is formed to prevent the air layer from being formed between the accommodation portion 110*a* and the golf club grip G. The air discharge hole 110*c* may be prepared with the same diameter as the accommodation portion 110*a* so that the second guide member 130 may be drawn from the accommodation portion 110*a* through the air discharge hole 110*c*.

The first guide member 120 is interposed between the accommodation portion 110*a* and the golf club grip G and reduces a friction applied to the golf club grip G to guide movement of the golf club grip G, and after the golf club grip G is inserted into the accommodation portion 110*a*, the first guide member 120 is separated from the accommodation portion 110*a*. For this, as shown in FIG. 9, the first guide member 120 includes a first gripping portion 121 exposed out of the accommodation portion 110*a* to give a gripping surface, and a first guide unit 122 extending from the accommodation portion 110*a* and inserted into the accommodation portion 110*a* to guide movement of the golf club grip G. The first guide member 120 may be made of, for example, polypropylene (PP) or other soft synthetic resin materials having a relatively low friction coefficient to give a slippery property, without being limited thereto.

The first guide member 120 has substantially the same configuration as in the grip aid 1 for a golf club according to the first embodiment of the present disclosure as depicted in FIG. 8, except that the direction leader 126 is additionally provided at the first gripping portion 121. Therefore, any feature identical to that of the first embodiment will not be described in detail here.

When the golf club grip G is inserted into the accommodation portion 110*a*, the first gripping portion 121 guides the golf club grip G to the accommodation portion 110*a*, and when the first guide member 120 is separated from the grip aid body 110, the first gripping portion 121 gives a gripping surface for gripping the first guide member 120. For this, as shown in FIG. 9, the first gripping portion 121 includes a handle 123 giving a gripping surface, a fixing groove 125 for fixing the accommodation portion 110*a* to the first gripping portion 121, and a direction leader 126 for indicating a reference direction to mount the grip aid body 110 to a predetermined regular position of the golf club grip G. In addition, the first gripping portion 121 is composed of a first gripping unit 121*b* and a second gripping unit 121*c* having the same structure and separable from each other by the coupling projection 127 and the coupling groove 128.

The direction leader 126 is formed at the outer side of the first gripping portion 121 and indicates a reference direction so that the grip aid body 110 may be mounted at a predetermined regular position of the golf club grip G. When the golf club grip G is inserted into the accommodation portion 110*a* through the inlet 110*b* of the grip aid body 110, the direction leader 114 of the grip aid body 110 and the direction leader D of the golf club grip G are spaced from each other by means of the first gripping portion 121. By doing so, it is not easy to exactly figure out whether the direction leader 114 of the grip aid body 110 forms a straight line with the direction leader D of the golf club grip G, and thus the first gripping portion 121 also includes the direction leader 126 to solve this problem, similar to the grip aid body 110.

As shown in FIG. 9, the direction leader 126 is formed at the outer side of the first gripping portion 121 to form a straight line with the direction leader 114 of the grip aid body 110. Therefore, the grip aid body 110 and the first guide member 120 may be coupled so that the direction leader 126 of the first gripping portion 121 and the direction leader 114 of the grip aid body 110 form a straight line. If so, when the golf club grip G is inserted into the accommodation portion 110*a*, the golf club grip G may be inserted into the accommodation portion 110*a* so that the direction leader 114 of the grip aid body 110 and the direction leader D of the golf club grip G form a straight line by means of the direction leader 126 of the first gripping portion 121.

The first guide unit 122 is formed to extend from the rear end of the first gripping portion 121 and detachably inserted into the accommodation portion 110*a*, and when the golf club grip G is inserted into the accommodation portion 110*a*, the first guide unit 122 is interposed between the accommodation portion 110*a* and the golf club grip G to guide movement of the golf club grip G. The first guide unit 122 is different from the first guide unit 22 of the grip aid 1 for a golf club according to the first embodiment of the present disclosure as depicted in FIG. 8, just in a point that the first guide unit 122 comes into contact with the second guide unit 134 of the second guide member 130 instead of the golf club grip G.

The first guide unit 122 includes a guide projection 124 formed to protrude along a longitudinal direction thereof. As shown in FIG. 9, the guide projection 124 may protrude from the outer side of the first guide unit 122 to make a linear contact with the inner side of the accommodation portion 110*a*. In addition, the guide projection 124 may protrude from the inner side of the first guide unit 122 to make a linear contact with the outer side of the second guide member 130 or may also be formed at both the outer and inner sides of the first guide unit 122.

Figure 11:
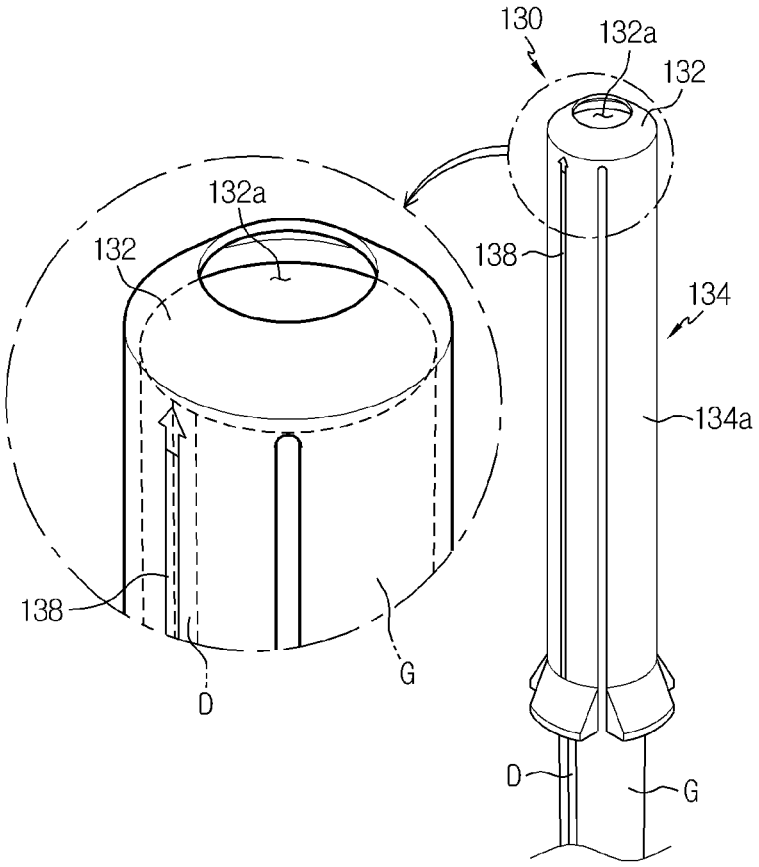
FIG. 11 is a perspective view showing the grip aid for a golf club according to the second embodiment of the present disclosure, in which a second guide member and a golf club grip are coupled.

FIG. 11 is a perspective view showing the grip aid for a golf club according to the second embodiment of the present disclosure, in which a second guide member and a golf club grip are coupled.

In the grip aid 1 for a golf club according to the first embodiment of the present disclosure, the first guide unit 22 of the first guide member 20 made of soft synthetic resin having a low friction coefficient is interposed between the accommodation portion 10*a* and the golf club grip G, considering that the golf club grip G and the grip aid body 10 are made of rubber or other synthetic resin materials having a relatively high friction coefficient. Therefore, the golf club grip G comes into contact with the first guide unit 22 instead of the accommodation portion 10*a*, and thus, the friction applied to the golf club grip G is reduced in comparison to the case where the golf club grip G directly contacts the accommodation portion 10*a*. However, due to the high friction coefficient of the golf club grip G, the friction may not be sufficiently reduced even though the first guide unit 22 is interposed between the golf club grip G and the accommodation portion 10*a*. To solve this problem, the grip aid 2 for a golf club according to the second embodiment of the present disclosure includes a second guide member 130 inserted into the accommodation portion 110*a* while surrounding the golf club grip G when the golf club grip G is inserted into the accommodation portion 110*a*, so that the golf club grip G does not directly contact the first guide member 120.

When the golf club grip G is inserted into the accommodation portion 110*a*, the second guide member 130 is inserted into the accommodation portion 110*a* in a state of surrounding the golf club grip G, and moves along the accommodation portion 110*a* together with the golf club grip G to prevent the golf club grip G from directly contacting the first guide member 120. In other words, the second guide member 130 is interposed between the golf club grip G and the first guide member 120 to contact the first guide member 120 instead of the golf club grip G, and by doing so, the second guide member 130 reduces a friction occurring when the golf club grip G is inserted into the accommodation portion 110*a*, thereby guiding movement of the golf club grip G. Also, after the golf club grip G is inserted into the accommodation portion 110*a*, the second guide member 130 is separated from the accommodation portion 110*a*. For this, as shown in FIG. 11, the second guide member 130 includes a second gripping portion 132 exposed out of the accommodation portion 110*a* to give a gripping surface, a second guide unit 134 into which the golf club grip G is detachably inserted, the second guide unit 134 being inserted into the accommodation portion 110*a* in a state of surrounding the golf club grip G to guide movement of the golf club grip G, and a protrusion 136 protruding from the outer side of the second guide unit 134 to form a gap between the first guide member 120 and the second guide member 130. The second guide member 130 may be made of, for example, polypropylene (PP) or other soft synthetic resin materials having a relatively low friction coefficient to give a slippery property, without being limited thereto.

The second gripping portion 132 is provided at the front end of the second guide member 130, and when the golf club grip G is inserted into the accommodation portion 110*a*, the second gripping portion 132 is exposed out of the accommodation portion 110*a* through the air discharge hole 110*c* to give a gripping surface. The shape of the second gripping portion 132 is not specially limited. For example, as shown in FIG. 11, the second gripping portion 132 has a curved shape with a rounded protrusion to form a predetermined space therein, and a gripping hole 132*a* is formed at the center thereof so that the second gripping portion 132 may be easily gripped. A method for separating the second guide member 130 from the grip aid body 110 by using the second gripping portion 132 will be described later in detail.

The second guide unit 134 is formed at the rear end of the second gripping portion 132 to extend therefrom, and at least a part of the golf club grip G is detachably inserted therein. The second guide unit 134 includes a direction leader 138 for indicating a reference direction to mount the grip aid body 110 to a predetermined regular position of the golf club grip G. The second guide unit 134 may have the same length as or a slightly shorter length than the grip aid body 110 in order to prevent the first guide unit 122 from directly contacting the golf club grip G.

The shape of the second guide unit 134 is not specially limited. For example, as shown in FIG. 11, the second guide unit 134 may be composed of a plurality of guide units 134*a* which individually extend from the second gripping portion 132 to surround at least a part of the golf club grip G. Since the golf club grip G generally has an increasing diameter from its end, the second guide unit 134 is composed of the plurality of guide units 134*a* so that the golf club grip G may be inserted into the inner space of the second guide unit 134 while elastically deforming the second guide unit 134. Each guide unit 134*a* has the same curvature as the golf club grip G to surround at least a part of the golf club grip G.

The direction leader 138 is formed at the outer side of at least one of the guide units 134*a* and designates a reference direction so that the grip aid body 110 may be mounted at a predetermined regular position of the golf club grip G. Since the golf club grip G is inserted into the accommodation portion 110*a* in a state of being covered by the second guide member 130, the direction leader D of the golf club grip G may not be easily recognized since the direction leader D of the golf club grip G is hidden by the guide unit 134*a*. Therefore, as shown in FIG. 11, the second guide member 130 is made of transparent material so that the direction leader of the golf club grip G may be recognized even though the golf club grip G is covered by the second guide member 130, and additionally the direction leader 138 is provided at the outer side of the guide unit 134*a* to form a straight line with the direction leader D of the golf club C.

The protrusion 136 is formed to protrude from the outer side of the second guide unit 134 and forms a predetermined gap between the first guide unit 122 and the second guide unit 134. If the second guide unit 134 is closely adhered to the first guide unit 122, the second guide unit 134 is pressed due to the elastic force of the grip aid body 110, and thus the second guide unit 134 may not be easily drawn from the accommodation portion 110*a*. Therefore, the protrusion 136 is provided to push the first guide unit 122 in a radial direction of the golf club grip G and thus form a gap between the first guide unit 122 and the second guide unit 134 so that the first guide unit 122 and the second guide unit 134 are not closely adhered to each other. As shown in FIG. 11, the protrusion 136 may be formed to protrude from the rear end of each guide unit 134*a*, without being limited thereto.

FIGS. 12 to 18 are perspective views and cross-sectional views for illustrating a process of mounting a grip aid body of the grip aid for a golf club according to the second embodiment of the present disclosure to a golf club grip.

Hereinafter, a process of mounting the grip aid body 110 to the golf club grip G by using the grip aid 2 for a golf club according to the second embodiment of the present disclosure will be described with reference to FIGS. 12 to 18.

Figure 12:
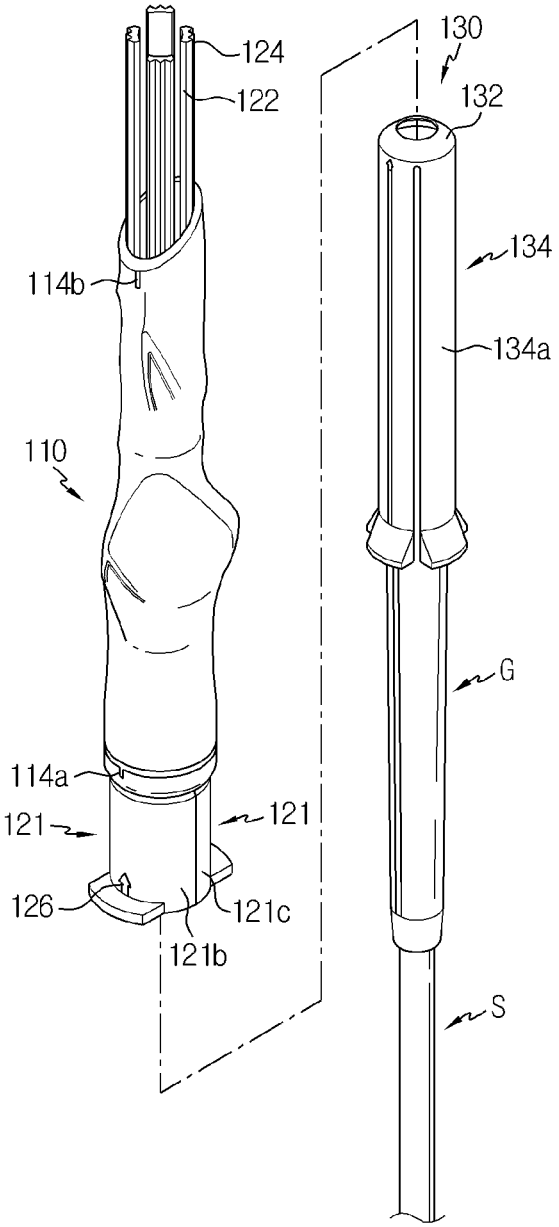
FIGS. 12 to 18 are perspective views and cross-sectional views for illustrating a process of mounting a grip aid body of the grip aid for a golf club according to the second embodiment of the present disclosure to a golf club grip.

First, as shown in FIG. 12, the first guide unit 122 is inserted into the accommodation portion 110*a*, and the front end of the accommodation portion 110*a* is fixed to the fixing groove 125 of the first gripping portion 121 to couple the first guide member 120 to the grip aid body 110. The first guide member 120 and the grip aid body 110 may be coupled so that the direction leader 114 of the grip aid body 110 and the direction leader 126 of the first guide member 120 form a straight line with each other.

Next, as shown in FIG. 12, the golf club grip G is inserted into the second guide unit 134 to couple the second guide member 130 to the golf club grip G. The second guide member 130 and the golf club grip G may be coupled so that the direction leader 138 of the second guide member 130 and the direction leader D of the golf club grip G form a straight line with each other.

Figure 13:
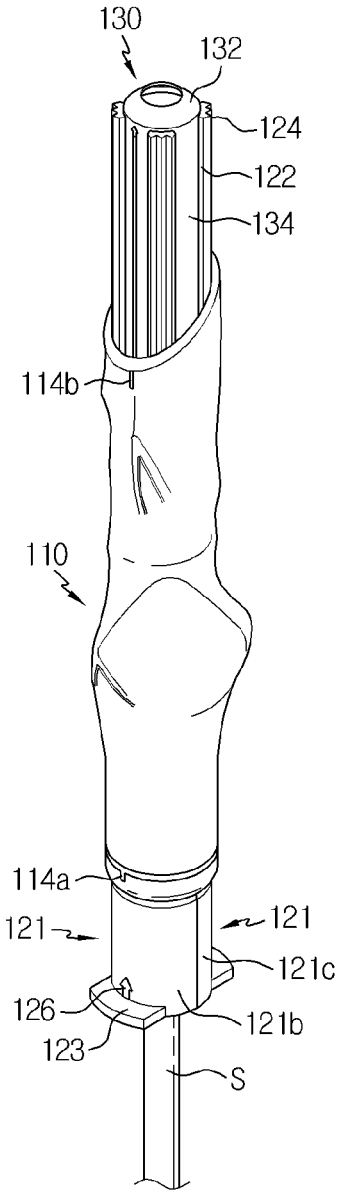
Figure 14A:
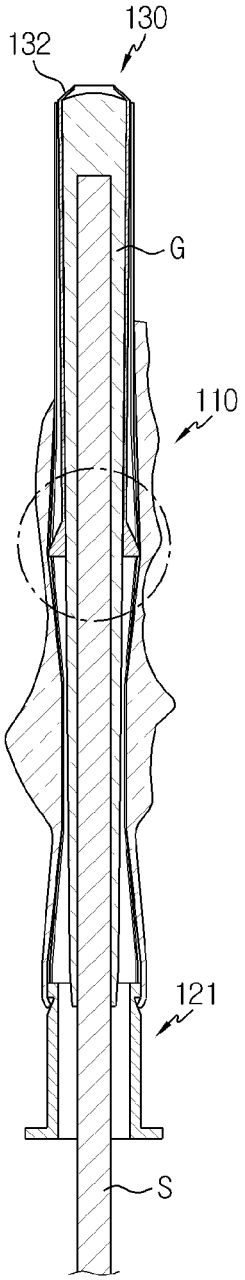
Figure 14B:
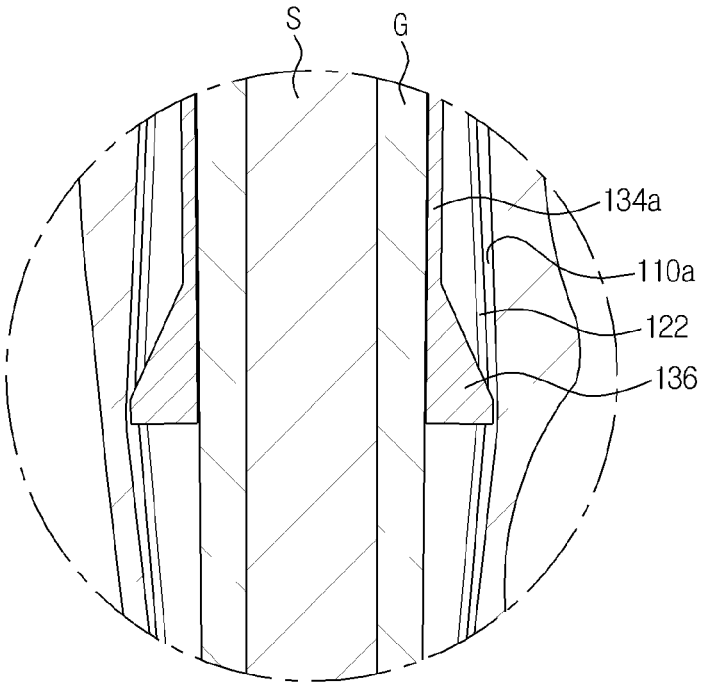

After that, as shown in FIG. 13, the golf club grip G coupled to the second guide member 130 is inserted into the accommodation portion 110*a* coupled to the first guide member 120. Since the golf club grip G is covered by the second guide unit 134 and the first guide unit 122 is inserted into the accommodation portion 110*a*, as shown in FIGS. 14*a* and 14*b*, if the golf club grip G is inserted into the accommodation portion 110*a*, the first guide unit 122 and the second guide unit 134 are interposed between the golf club grip G and the accommodation portion 110*a*. By doing so, when the golf club grip G is moved along the accommodation portion 110*a*, the first guide unit 122 just comes into contact with only the second guide unit 134. Since the first guide unit 122 and the second guide unit 134 are made of soft synthetic resin material with a relatively low friction coefficient, when the golf club grip G is moved along the accommodation portion 110*a*, a relatively weak friction occurs between the first guide unit 122 and the second guide unit 134. Therefore, the golf club grip G may be easily inserted into the accommodation portion 110*a* without any great force.

In addition, the golf club grip G may be inserted into the accommodation portion 110*a* so that the direction leader D of the golf club grip G, the direction leader 138 of the second guide member 130, the direction leader 126 of the first guide member 120, and the direction leader 114 of the grip aid body 110 form a straight line with each other. If so, the grip aid body 110 may be mounted at a predetermined regular position of the golf club grip G, thereby preventing erroneous mounting.

In addition, the golf club grip G is inserted so that the second gripping portion 132 is exposed out of the accommodation portion 110*a* through the air discharge hole 110*c*. The length by which the golf club grip G is inserted into the accommodation portion 110*a* may vary depending on a location of the golf club grip G where the grip aid body 110 is to be mounted. For example, if a user intends to swing the golf club C while holding the golf club C shortly, the golf club grip G may be inserted deeply into the accommodation portion 110*a*, but if a user intends to swing while holding the golf club C long, the golf club grip G may be inserted shallowly into the accommodation portion 110*a*. A length measurement line (not shown) may also be formed at an end of the first guide unit 122 so as to measure the length by which the golf club grip G is inserted into the accommodation portion 110*a*.

Next, the second guide member 130 is separated from the grip aid body 110. The second gripping portion 132 exposed out of the accommodation portion 110*a* through the air discharge hole 110*c* is drawn out of the accommodation portion 110*a* to draw the second guide unit 134 from the accommodation portion 110*a*, thereby separating the second guide member 130 from the grip aid body 110.

Figure 15:
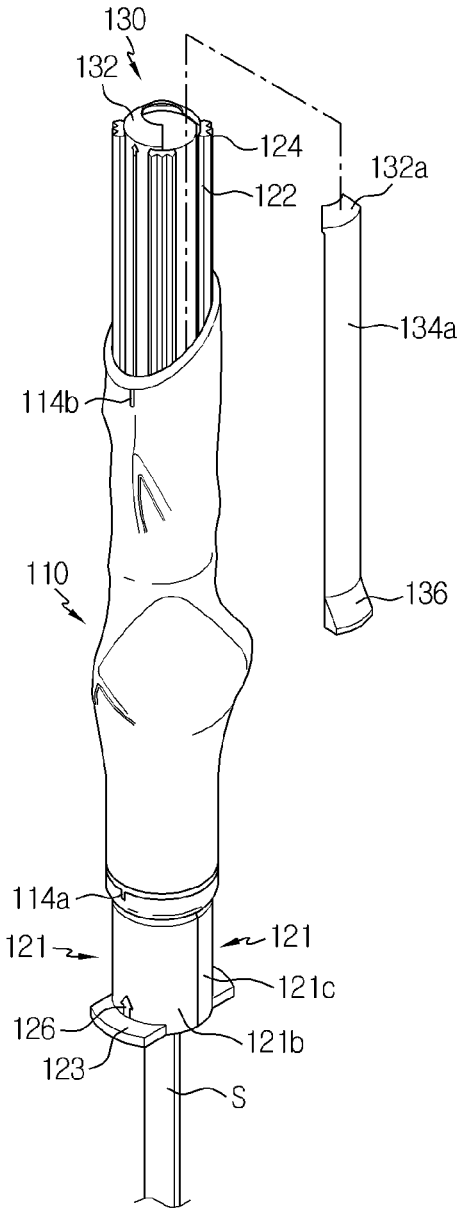
Figure 16:
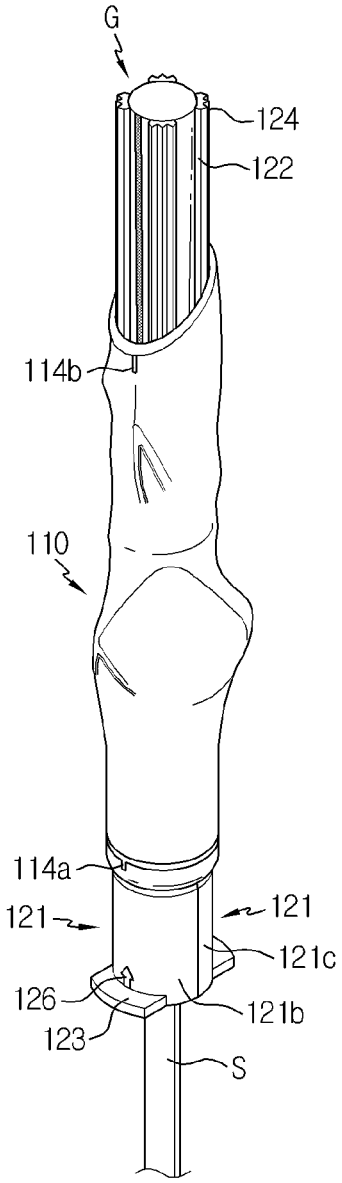

However, if all of the guide units 134*a* of the second guide unit 134 are drawn at once from the accommodation portion 110*a*, a great force is required, which makes it difficult to draw the second guide unit 134. Therefore, the guide units 134*a* may be individually drawn from the accommodation portion 110*a*. For example, as shown in FIGS. 15 and 16, the second gripping portion 132 may be cut into several pieces 132*a* with a nipper or scissors, and each piece 132*a* may be drawn out of the accommodation portion 110*a* so that the guide unit 134*a* connected to each piece 132*a* may be individually drawn from the accommodation portion 110*a*. By doing so, the force required for drawing the second guide unit 134 from the accommodation portion 110*a* may be distributed, and thus the second guide member 130 may be easily separated from the grip aid body 110.

In addition, when the second guide unit 134 is drawn from the accommodation portion 110*a*, the protrusion 136 forms a gap between the first guide unit 122 and the second guide unit 134 to prevent the first guide unit 122 from being closely adhered to the second guide unit 134, and thus the second guide member 130 may be separated from the grip aid body 110 more easily (see FIG. 14*b*).

After that, the first guide member 120 is separated from the grip aid body 110. The first gripping portion 121 exposed out of the accommodation portion 110*a* through the inlet 110*b* is pulled outwards from the accommodation portion 110*a* to draw the first guide unit 122 from the accommodation portion 110*a*, thereby separating the first guide member 120 from the accommodation portion 110*a*.

Figure 17:
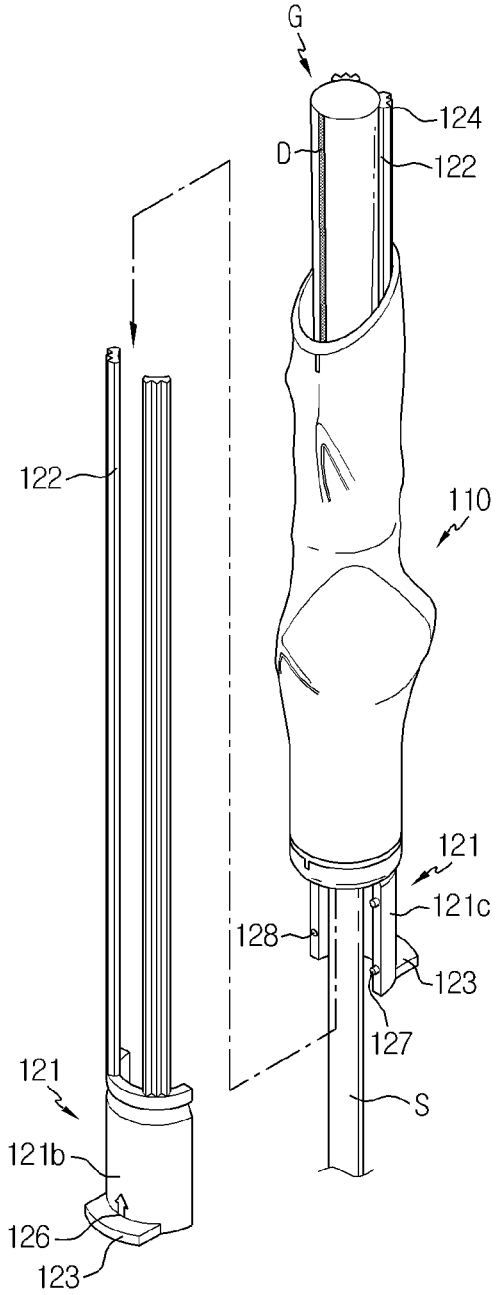
Figure 18:
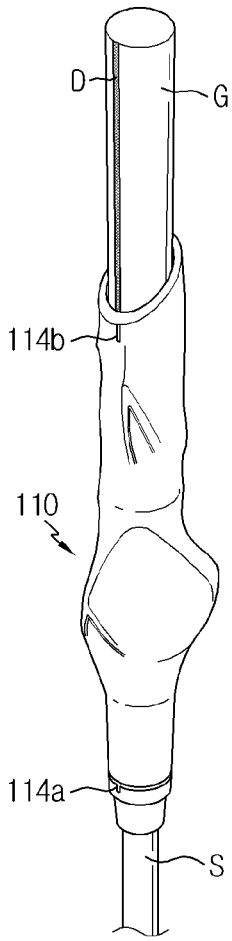

However, since the plurality of first guide units 122 are inserted into the accommodation portion 110*a*, a great force is required for drawing all the first guide units 122 at once from the accommodation portion 110*a*, which may make it difficult to draw the first guide units 122. Therefore, the first guide units 122 may be individually drawn from the accommodation portion 110*a*. For example, as shown in FIGS. 17 and 18, the coupling projection 127 may be separated from the coupling groove 128 to release the coupling between the first gripping unit 121*b* and the second gripping unit 121*c*, and then each gripping unit 121*b*, 121*c* may be pulled outwards from the accommodation portion 110*a* so that the first guide unit 122 connected to each gripping unit 121*b*, 121*c* may be individually drawn from the accommodation portion 110*a*. By doing so, the force required for drawing the first guide unit 122 from the accommodation portion 110*a* may be distributed, and thus the first guide member 120 may be easily separated from the grip aid body 110.

If the first guide member 120 is separated from the grip aid body 110, as shown in FIG. 18, the grip aid body 110 is shrunken by means of elastic force. By doing so, the inner side of the accommodation portion 110*a* is closely adhered to the outer side of the golf club grip G so that the grip aid body 110 is coupled to the golf club grip G.

Meanwhile, even though it has been illustrated that the first guide member 120 is separated from the grip aid body 110 after the second guide member 130 is separated from the grip aid body 110, the present disclosure is not limited thereto. In other words, it is also possible that the second guide member 130 is separated from the grip aid body 110 after the first guide member 120 is separated from the grip aid body 110.

The present disclosure has been described in detail. However, it should be understood that the detailed description and specific examples, while indicating preferred embodiments of the disclosure, are given by way of illustration only, since various changes and modifications within the scope of the disclosure will become apparent to those skilled in the art from this detailed description.

What is claimed is:

1. A grip aid for a golf club, comprising:

a grip aid body having an accommodation portion into which a golf club grip is inserted, and a projection for setting a gripping location of a golf club; and a first guide member detachably inserted into the accommodation portion and interposed between the accommodation portion and the golf club grip to guide movement of the golf club grip when the golf club grip is inserted into the accommodation portion, wherein after the golf club grip is inserted into the accommodation portion, the first guide member is drawn out of the accommodation portion so that the grip aid body is closely adhered to the golf club grip, wherein the first guide member includes:

a first gripping portion exposed out of the accommodation portion to give a gripping surface; and a first guide unit detachably inserted into the accommodation portion to guide movement of the golf club grip, and wherein the first gripping portion includes:

a guide hole configured to guide the golf club grip to the accommodation portion when the golf club grip is inserted into the accommodation portion; and a fixing groove formed with a predetermined depth along a periphery of an outer side thereof so that one end of the accommodation portion is detachably coupled thereto to fix the grip aid body.

2. The grip aid for a golf club according to claim 1, wherein the grip aid body has flexible elastic material.

3. The grip aid for a golf club according to claim 2, wherein the accommodation portion has a smaller diameter than the golf club grip, and wherein the golf club grip is inserted into the accommodation portion while expanding the grip aid body, and when the first guide member is drawn from the accommodation portion, the grip aid body is shrunken so that an inner side of the accommodation portion is closely adhered to an outer side of the golf club grip.

4. The grip aid for a golf club according to claim 1, wherein the grip aid body further includes wrinkles formed along a longitudinal direction thereof and flexible in a circumferential direction of the grip aid body.

5. The grip aid for a golf club according to claim 1, wherein the first gripping portion is composed of a plurality of gripping units detachably coupled to each other, and the first guide unit is individually formed at each gripping unit.

6. The grip aid for a golf club according to claim 5, wherein the first guide unit is inserted into the accommodation portion in a state where the plurality of gripping units are coupled to each other, and wherein when the golf club grip is inserted into the accommodation portion, the plurality of gripping units are separated from each other, respectively, so that the first guide unit connected to each gripping unit is individually drawn from the accommodation portion.

7. The grip aid for a golf club according to claim 1, wherein the first guide unit has at least one guide projection protruding along a longitudinal direction thereof to contact at least one of an inner side of the accommodation portion and an outer side of the golf club grip.

8. A grip aid for a golf club comprising:

a grip aid body having an accommodation portion into which a golf club grip is inserted, and a projection for setting a gripping location of a golf club;

a first guide member detachably inserted into the accommodation portion and interposed between the accommodation portion and the golf club grip to guide movement of the golf club grip when the golf club grip is inserted into the accommodation portion, wherein after the golf club grip is inserted into the accommodation portion, the first guide member is drawn out of the accommodation portion so that the grip aid body is closely adhered to the golf club grip; and a second guide member into which at least a part of the golf club grip is detachably inserted, wherein when the golf club grip is inserted into the accommodation portion, the second guide member is interposed between the first guide member and the golf club grip to guide movement of the golf club grip, wherein after the golf club grip is inserted into the accommodation portion, the second guide member is drawn out of the accommodation portion so that the grip aid body is closely adhered to the golf club grip.

9. The grip aid for a golf club according to claim 8, wherein the second guide member includes:

a second gripping portion exposed out of the accommodation portion to give a gripping surface; and a second guide unit detachably inserted into the golf club grip, the second guide unit being inserted into the accommodation portion in a state of surrounding the golf club grip to guide movement of the golf club grip.

10. The grip aid for a golf club according to claim 9, wherein the second guide member further includes a protrusion protruding from an outer side of the second guide unit to form a gap between the first guide member and the second guide unit.

11. The grip aid for a golf club according to claim 10, wherein the second guide unit is composed of a plurality of guide units individually extending from the second gripping portion to surround at least a part of the golf club grip.

12. The grip aid for a golf club according to claim 8, wherein at least one of the grip aid body, the first guide member and the second guide member has a direction leader for indicating a reference direction to mount the grip aid body at a predetermined regular position of the golf club grip.

* * * * *